United States Patent [19]

Harigai

[11] 4,395,619

[45] Jul. 26, 1983

[54] HAND HELD HAIR DRYER WITH SHOCK MOUNTED QUARTZ TUBE HEATER

[75] Inventor: Hiroshi Harigai, Tokyo, Japan

[73] Assignee: Yamada Electric Industries, Co. Ltd., Chiba, Japan

[21] Appl. No.: 260,603

[22] Filed: May 6, 1981

[51] Int. Cl.[3] ..... F24H 3/00; H05B 1/00

[52] U.S. Cl. ..... 219/377; 219/347; 219/357; 219/536; 219/542; 219/552; 248/50

[58] Field of Search ..... 219/377, 347, 357, 536, 219/552, 542; 248/62, 74 A, 74 B, 74 PB, 74 R, 50; 338/316; 362/217

[56] References Cited

U.S. PATENT DOCUMENTS

| | | | |
|---|---|---|---|
| 1,127,082 | 2/1915 | O'Brien | 362/217 |
| 1,722,363 | 7/1929 | Young | 248/50 |
| 1,965,882 | 7/1934 | Cook | 248/74 R |
| 2,709,558 | 5/1955 | Young | 248/74 B |
| 4,323,761 | 4/1982 | Hubner | 219/377 |

FOREIGN PATENT DOCUMENTS

| | | | |
|---|---|---|---|
| 2038623 | 7/1980 | United Kingdom | 219/377 |

*Primary Examiner*—B. A. Reynolds
*Assistant Examiner*—Marvin M. Lateef
*Attorney, Agent, or Firm*—J. David Dainow

[57] ABSTRACT

A hair dryer having a quartz glass tube heater to produce radiant heat has a shock mount sub-assembly to resist breakage of the tube when the hairdryer is subjected to drop tests or other selected concussions. The shock mounts include spring members which are flexible and resilient relative to the housing and furthermore have resilient engagement with the tube to allow slight but controlled movement of the tube without breakage regardless of the direction of impact or orientation of the hairdryer when dropped. An internal blower for creating an air flow through this quartz tube heater hairdryer may be included as a safety feature to prevent overheating and to provide nominal air flow for conventional type drying.

9 Claims, 5 Drawing Figures

FIG. 3
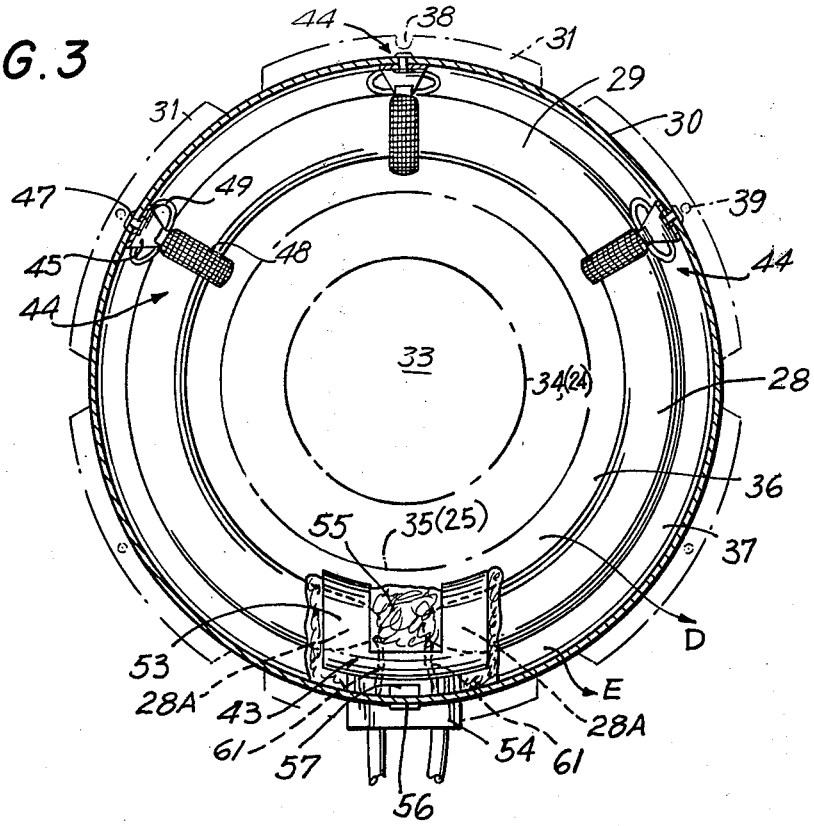
FIG. 4
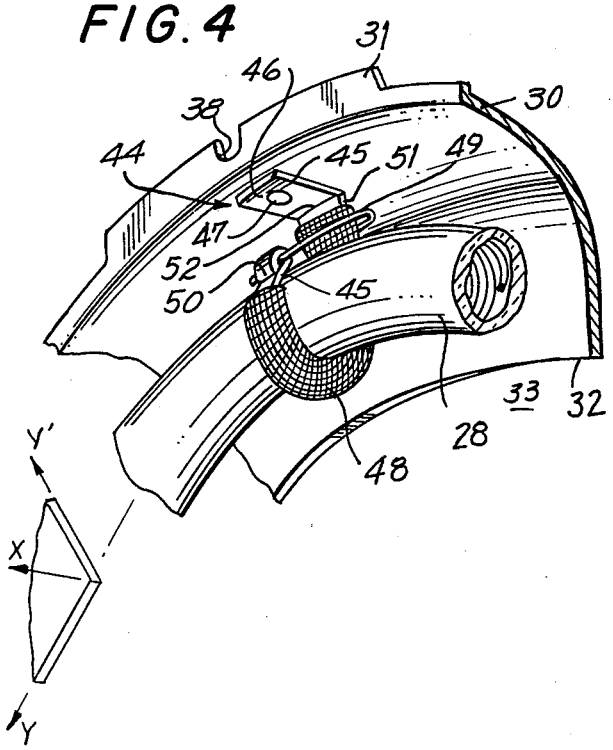
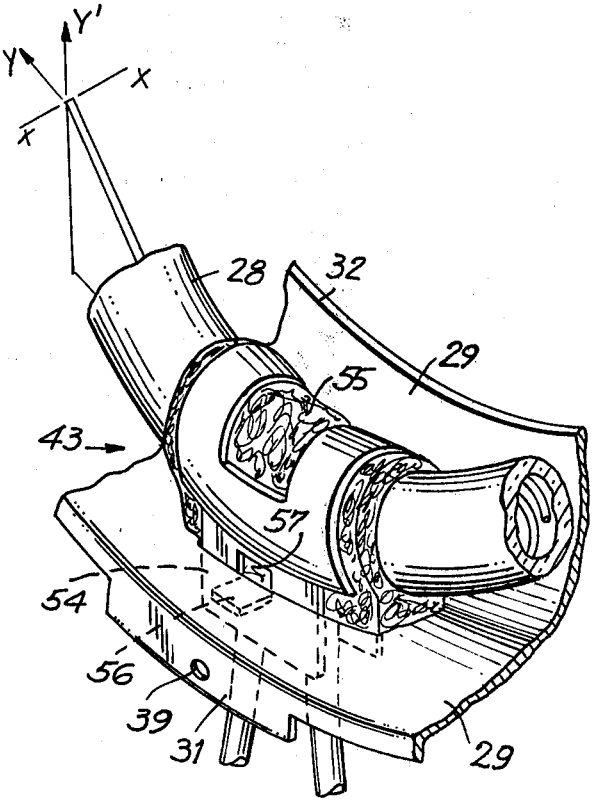
FIG. 5

HAND HELD HAIR DRYER WITH SHOCK MOUNTED QUARTZ TUBE HEATER

BACKGROUND OF THE INVENTION

Electric hair dryers have become extremely popular consumer products in recent years and are available in a variety of shapes and operational types, particularly hand-held pistol grip types and others. For reasons of sales promotion and to provide more efficient drying of wet hair, manufacturers have tended to increase the power of either the blower component or the heating component or both in these dryers. Another objective has been to produce the high heating or air flow capabilities in smaller housings, and additionally to achieving higher operating efficiencies and safety and to produce these devices as economically as possible.

Even with the developments mentioned above and improvements in hair dryer design and capability, there has been a persistent disadvantage with these high powered devices, in that the user's hair is blown out of place or otherwise so disturbed that the users often must return to the old slower dryers.

An attempt to provide hair drying capability with reduced air velocity has been made with the development of new dryers which have a quartz tube heating element, preferably in combination with a reflector for producing a substantially high quantity of directed radiant heat to the user's hair with little or no air flow required. In practice it has been found that a very small blower unit is helpful or necessary to move the air about inside the housing of a quartz tube dryer, thereby cooling and preventing the housing components from overheating due to the extremely high-temperature quartz tube. Additionally the small blower will produce a moderate air flow which has the normal hair drying effect.

With these quartz tube dryers the problems of wind blown hair are substantially reduced; however it has been found that the quartz tube elements are highly susceptible to breakage should the device be accidentally dropped or banged against a rigid surface. Breakage of such hair dryers can be very dangerous to users because the glass tubes shatter producing a multitude of glass splinters with the obvious kinds of consequences. These types of concussions easily happen with consumer products of this type which are frequently moved into and out of storage areas such as drawers and closets, are carried around between rooms, and are carried in luggage during travel.

These tubes are particularly fragile for various reasons: the tube's glass wall construction is not reliably of uniform thickness, thus resulting in randomly located weak areas; traditional soft type cushioning, shock mount materials and techniques are not feasible, because of the intense high temperatures reached; and traditional ceramic support structures which can easily tolerate the heat are rigid, the lack of resilience resulting in a very substantial amount of breakage of these tubes during normal use or when subjected to intentional impact. The above-mentioned inconsistency in wall thickness of the tube worsens the problem since it is not feasible to locate and situate the stronger portions in contact with the mounts, and the weak portions may fail due to concussion anyway.

The breakage problem has been sufficiently serious and so difficult to solve, that regulating agencies in the United States, such as the Underwriters Laboratory, have been denying approval to these prior art and known products on the grounds that they are unsafe, because they cannot withstand the standard drop test, whereby the product is dropped three times onto a hardwood surface from a three foot height, with the product being dropped in random orientations; these drop tests are conducted at both manufacturing locations and at the Underwriters Laboratory itself under more controlled conditions. The prior art devices continue to fail these tests with both straight and circular quartz heating tubes. Without the Underwriters Laboratory approval these products cannot be marketed in most major markets in the United States, representing, in effect, a product that is physically producible but not practical for manufacture because sales are prohibited and/or consumers would ultimately be dissatisfied with the high breakage factor.

The present invention provides a new construction for mounting and supporting the quartz glass heating tubes in a manner which has been found to be reliably safe for preventing breakage under both normal use and under the above-mentioned standard drop test. Accordingly, the invention makes it possible for new dryers to utilize the quartz glass heating tubes and provide the benefits available therewith on a feasible and manufacturable basis. This is a significant invention, in that it will make possible the development of a whole new family of hair dryers and accordingly a whole new and long-needed sub-market.

SUMMARY OF THE INVENTION

The new hair dryer disclosed herein has a basic housing with air flow inlet and outlet apertures, an electric motor and fan for creating an air flow through the housing between said inlet and outlet apertures, and a quartz glass tube heater assembly mounted within the housing. The objective and function of this hair dryer is primarily to provide a source of radiant heat energy; the air flow and electric motor and fan therefore represent an added, optional feature for the user's convenience, and serve the safety function to cool the tube and adjacent housing and thereby prevent overheating.

The quartz glass tube heater herein is generally annular in shape with an internal electrical heating element and appropriate electrical circuit and control means as known in the prior art. For optimum efficiency the tube is situated adjacent an annular reflector, and for convenience the tube has been mounted onto the reflector, the latter then mounted separately to the housing. The invention herein is directed primarily to the subassembly for securely and safely mounting the tube to the reflector, with the understanding that the tube could be mounted by such subassembly to some other part of the housing. By this new mounting arrangement a plurality of circumferentially spaced connector elements resiliently engage the tube, each element also being resilient relative to the reflector. The typical new mounting connectors are formed of resilient straps of flat spring steel sheathed in fiber glass fabric in the area which surrounds and contacts the quartz glass tube. One end of each strap is fixedly secured to the reflector, while the other end is resiliently secured by a second spring element to the first end or nearby part. The second spring means may be a loop of separate spring wire or a contiguous part of the original strap, the function being to allow slight controlled or restrained movement of the tube in all possible directions relative to the housing, as might be caused by drop tests with the hair dryer positioned in random orientations.

In the new hair dryer a typical quartz tube is curved to form a circle with its two ends adjacent and slightly spaced circumferentially, and with the ends of the heater wire extending outward therefrom and thence to circuit and power source means in the handle of the hair dryer. The resilient mounting element or connector between these ends of the tube and the reflector, is formed of resilient material such as a spring metal strap secured to the reflector but movable relative thereto, with a layer of glass wool batting or other heat resistant cushioning material between the tube and the strap.

As stated above, the achievement herein is a subassembly for mounting a quartz glass heater tube in a manner that allows restrained movement in any direction during severe impact and concussion, with a substantial reduction or elimination of tube breakage. A preferred embodiment of this invention is illustrated in the accompanying drawings and described in the specification immediately following.

DESCRIPTION OF THE FIGURES AND THE PREFERRED EMBODIMENT

FIG. 3 is a plan view taken along lines 3—3 in FIG. 2, of the quartz tube heater and reflector mounting assembly;

FIG. 4 is a fragmentary, enlarged, perspective view of one of the mounting structures for the quartz tube shown in FIGS. 2 and 3, and FIG. 5 is fragmentary, perspective, enlarged view of a second mounting structure for the quartz tube illustrated in FIGS. 2 and 3.

Figure 1:
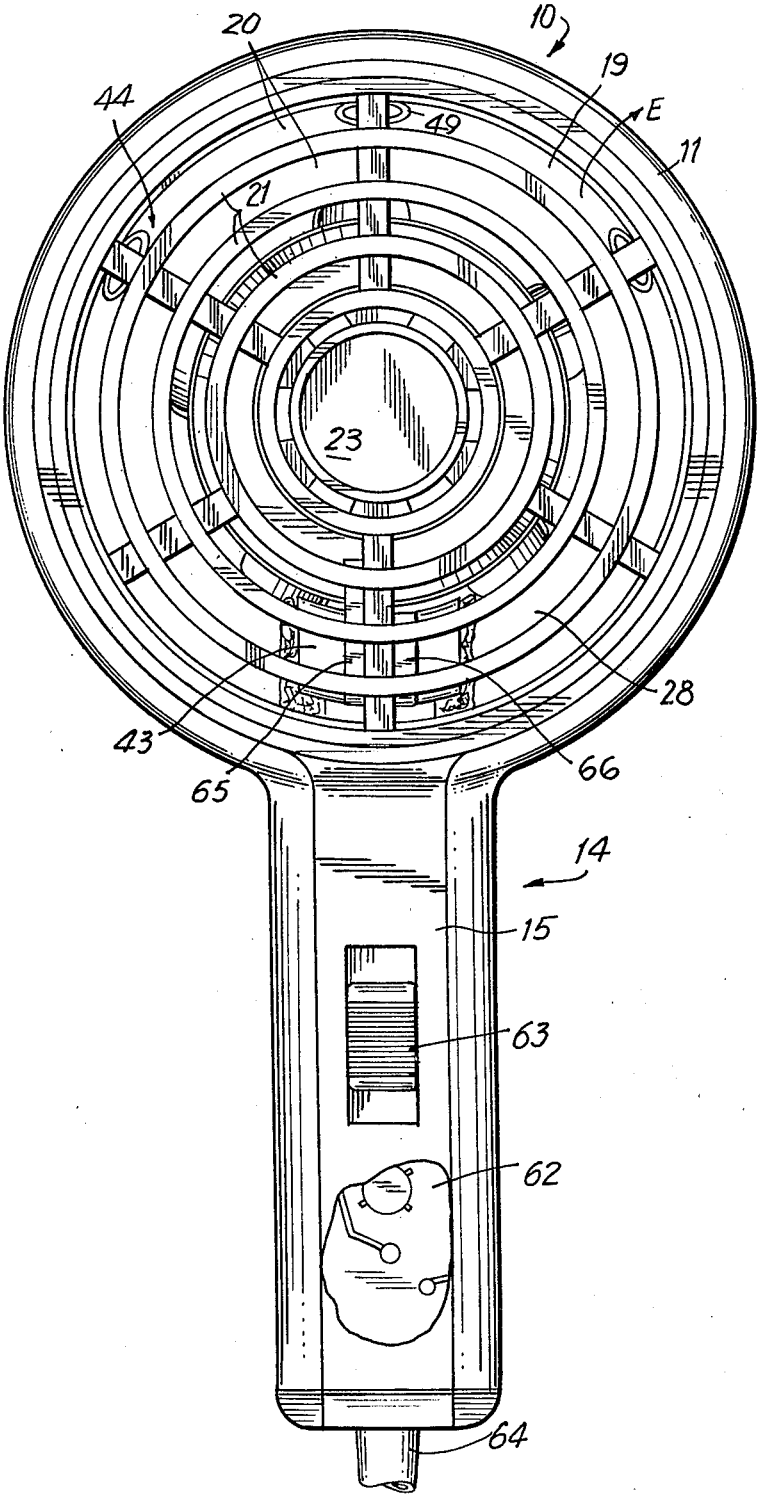
FIG. 1 is a top plan view of the new hair dryer.
Figure 2:
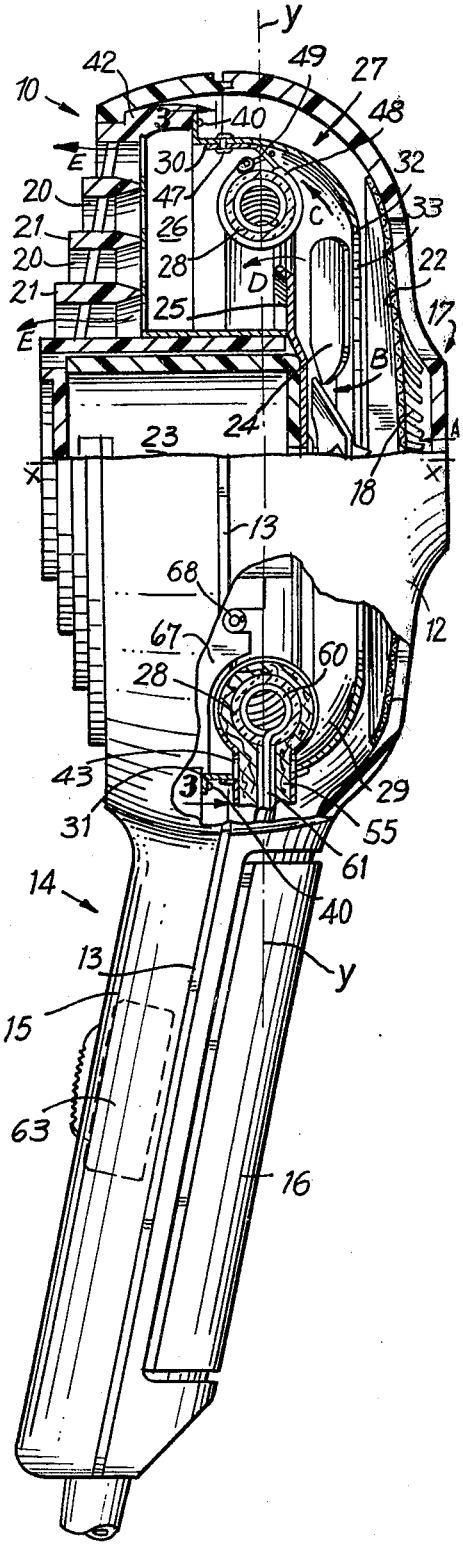
FIG. 2 is a right side elevation of the hair dryer shown partially in section.

In FIGS. 1 and 2 the new hair dryer apparatus 10 is shown with a basic housing formed by upper part 11 and lower part 12 which are preferably injection molded plastic shells connected along junction line 13. The housing extends in the form of a handle 14 comprising a top portion 15 and a bottom 16 which are continuous extensions of the top and bottom shells 11 and 12, respectively. This hair dryer apparatus has an inlet air opening 17 defined by perforations 18 in the bottom shell 12, and an outlet 19 in the top portion 11 formed by the spaces 20 between concentric rings 21. For safety purposes the inlet has a guard screen 22 adjacent to the inlet openings 18 to prevent hair or other objects from being sucked into the fan and other internal parts of the device. The blower of this hair dryer consists of a motor 23 mounted to the center of the upper shell 11 and extending downward through the middle of the housing, and terminating in fan blade 24 which is spaced axially below a baffle disc 25 which is also fixedly attached at the bottom of the motor. With this arrangement the air is drawn through inlet holes 18 as indicated by arrow A, then into the fan as indicated by arrow B, then directed by the fan blade tips radially outward as indicated by arrow C and directed axially upward as indicated by arrow D to the discharge area 26, as indicated by arrows E.

The heater assembly 27 consists primarily of the glass quartz tube 28 secured to an annular shaped reflector dish 29 which is shown in all FIGS. 2, 3, and 4. As indicated the reflector dish 29 has a top edge 30, top flange segments 31 extending generally radially outward relative to the central axis X—X of the device which is also the central axis of the motor, and the circular quartz tube. The reflector has a bottom edge 32 which is best shown in FIGS. 4 and 5, this bottom edge defining a circular opening 33 through which the air from inlet 17 passes when drawn by fan blades 24 upward as indicated by arrows A–E. In FIG. 3 the concentric circle indicated by reference 34 corresponds to and represents the position of motor 23, and the concentric circle indicated by reference number 35 represents and corresponds to the baffle 25, so that space indicated by reference 36 in FIG. 3 is where the air, represented by arrow D in FIG. 2, would flow upward along the inside of the quartz glass tube, and the space indicated by reference 37 in FIG. 3 is the space where air, represented by arrow E in FIG. 2, rises or is driven upward.

As illustrated in FIGS. 2–5 the reflector dish has notches 38 or apertures 39 through which screws 40 are extended for attaching the reflector via its flange 31 to an inner mounting ring 42 secured in the upper housing 11.

Next will be considered the arrangement for securely and safely mounting the quartz glass tube 28 in and to the reflector dish 29. For convenience only, the structure illustrated in FIG. 3 will be designated with respect to a clock face, such that a primary mounting subassembly 43 is located at the six o'clock position and secondary mounting subassemblies 44 are located at the 10, 12 and 2 o'clock positions.

The quartz tube 28 has an annular shape, and in this embodiment a circular cross-section, and is situated with its central axis X—X extending as shown in FIG. 2, with similar representations in FIGS. 4 and 5. Each of the secondary mount subassemblies 44 consists of a metal band 45 which is a stainless steel flat spring material having a first end 46 secured by a rivet 47 to the upper portion 30 of the reflector pan 29, this construction most clearly seen in FIG. 4.

Encasing the band 45 is a sleeve of fiber glass fabric 48 which provides a heat resistant and slightly cushioned layer between said metal band 45 and the outer surface of tube 28 contacted by the sleeve. Finally there is a spring wire clip 49 shown in FIGS. 1, 2, 3 and 4 which engages a top curved portion 50 of the spring clip and a lower portion 51, resiliently urging said portions toward each other, thereby securing gripping the quartz tube 28 which is substantially encircled by said ensheathed spring clip 45.

It should be observed that the tube 28 is generally circular in overall configuration, i.e., a ring which defines a plane perpendicular to axis X—X extending through the center of the ring. This plane through the tube is symbolically represented as Y—Y in FIG. 2, and symbolically represented in FIGS. 4 and 5 by coordinates Y and Y'. It can be seen more clearly in FIGS. 4 and 5 that the quartz tube 28 is mounted in a way to protect it from shocks which might occur in any of the X or Y directions. More particularly, the axial directions represented by axis X—X corresponds to an impact when the device is dropped while oriented in an upward or downward direction. If the device is oriented to strike on any of its side portions, the impact would be in the Y—Y plane, which might otherwise be considered the radially outward direction relative to axis X—X.

As regards an impact in the X—X axis direction, the mounting assembly 44 illustrated particularly in FIG. 4 has the spring clip 45 constructed in such a way that the ensheathed portion can resiliently bend at the bend line 52 or elsewhere along its length of the sheathed portion, due to this kind of stress. Furthermore the spring ring 49 allows the end 50 of the spring clip to move relative to the other end 51 of the spring clip, should the tube 28 be subjected to impact forces in either the X—X direction of the Y—Y plane. In addition to the resiliency of the subassembly 44, there is cushioning action provided by the fabric construction of the fiber glass sheath, which also prevents direct heat transfer by conduction into the reflector or the housing. The subassemblies 44 thus hold the portions of the tube 28 engaged by these subassemblies in suspension primarily to protect the tube and secondarily to protect the housing.

Focusing now on FIGS. 2, 3 and 5, the primary mounting subassembly 43 is shown to consist of a spring metal band which has a generally U-shape, namely a closed portion 53 which generally surrounds tube 28 and an open portion of parallel legs 54 which extend through an aperture in the wall of the reflector 29. Between this band and the tube is a heat resistant and cushioning glass wool batting material 55 or other ceramic fiber providing similar characteristics. The band has a tab 56 cut out of each leg 54 leaving a small aperture or window 57. As shown in the assembled condition, the legs 54 are extended radially outward through the aperture in the wall of reflector 29, and the tab 56 extends axially outward of and adjacent to the outside surface of the reflector. This tab on each leg prevents the spring collar 53 from moving radially inward toward axis X—X; the batting 55 which is packed between the collar 53 and the tube 28 and between the outer edge of the tube 28 and the inner edge of the reflector 29 resiliently restricts the tube from moving radially outward against the reflector and restricts the combination of the tube and sleeve 53 from moving outwardly in a similar manner.

The procedure for assembling this component would be to forceably squeeze the legs 54 together, thereby temporarily compressing the resilient batting before the legs 54 are extended through the aperture in reflector 29. Upon release of the leg portions, they would move away from each other in the axial direction, such that tab 56 would take the position shown in the Figures which effectively blocks the sleeve 53 from any major move radially inward.

Because the sleeve is resilient, flexible metal and because the batting is compressible, the quartz tube portion within this mounting subassembly can move slightly under impact. More particularly, the sleeve 53 can deflect slightly in the axial direction, i.e., along the X—X axis because of its inherent resilience allowing it to flex, and also because of its configuration and its attachment to the reflector via the aperture therethrough, which allows this sleeve to pivot slightly. This is another degree of movement of the sleeve still allowing the tube to move in the X—X direction.

The secondary support devices 44 are shown in the 10, 12 and 2 o'clock positions in FIG. 3, however, it is contemplated that fewer such devices could be used, i.e., by eliminating the 12 o'clock positions; also another device 44 could be substituted for the device 43, except that in this embodiment the mass of glass wool batting is useful to encase the tube ends where the heater wires exit. It is further contemplated that two such devices could be used in selected positions other than the 10 and 2 o'clock positions. It is not required that the double spring effect be provided by the flat spring clip 45 combined with the wire loop 49 as shown, as the device can take a variety of other forms which achieve a similar result, i.e., that the mount is movable somewhat relative to the housing or at least to the reflector dish. It should also be noted that the spring clip 44 as shown extends in a generally downward direction from rivet 47 under the bottom of the tube 28, then around the top, then returning via the spring wire toward the rivet. It is quite feasible to reverse the direction of the spring clip, in addition to altering the shape somewhat.

The quartz glass heater tube 28 is either a commercial product or is commercially makable; this tube is circular as shown having two adjacent ends 28A which approach each other within the primary mount 43, and appears in dotted lines since they are covered by the glass wool batting material 55. Within the quartz tube is a nichrome heater wire coil 60 illustrated in FIG. 2, which extends out of each end of the quartz tube as terminal 61 and extends further into handle 14, and thence to the circuit means 42 illustrated generally by the circuit board and components thereon which is controlled by switch 63 as shown in FIGS. 1 and 2. Obviously, the device is powered by standard current provided by power cord 64 extending outward of handle 14.

For efficiency and safety in operation there is a thermostat 65 near the outlet aperture which will respond to the temperature of air flowing therethrough, and a thermal fuse 66 generally adjacent the thermostat for breaking the power circuit should the device overheat. The electrical circuit for operating this quartz tube heater is commercially available and known from numerous prior art references. The housing of this device is secured together by standard spring clips, injection molded spring tabs in the shells where they engage along junction line 13, and/or threaded fasteners as might be selected. A small piece of mica 67 illustrated in FIG. 2 is provided for the mounting of the thermostat and thermal fuse, since the mounting support for these two components must be highly resistant to the heat which they are to sense. Other small pieces of mica, not shown, support an iron chrome coil 68 which is a part of the voltage dropper assembly of the circuit means of the device. The housing is preferably made of polycarbonate for its characteristics known to be suitable for electric heater home appliances of this type.

Although one embodiment of the present invention is illustrated and described in detail, it is to be expressly understood that the invention is not limited thereto. Various changes can be made in the design and arrangement of parts without departing from the spirit and scope of the invention as set forth in the claims.

What is claimed is:

1. In a hair dryer including a housing defining air inlet and outlet means, an electric motor mounted in said housing, a fan driven by said motor for creating an air flow through said housing from said inlet to said outlet, a heater assembly mounted in said housing, and circuit means for operating said motor and heater assembly, the improvement wherein said heater assembly comprises: a quartz glass heating tube for providing a radiant heat source, said tube having a generally annular shape about a central axis therethrough thereby defining axial and radial directions, with opposite ends of the tube adjacent but circumferentially spaced apart, the tube being situated axially intermediate said inlet and outlet means and at least partially in the path of said air flow, a reflector secured to said housing such that the tube is intermediate the reflector and the outlet means, and support means for securing said tube to said reflector comprising a primary support engaging said ends of said quartz tube and three secondary supports, the location of the primary support, with respect to a clock face reference being at 6 o'clock and the locations of said secondary supports being at approximately 10, 12 and 2 o'clock respectively, each of said supports having a first part at least partially encircling and resiliently holding the tube and a second part secured to said reflector, each of said supports permitting at least a small amount of motion of said tube in the axial direction relative to said reflector, said supports also providing resilient cushioning support for said tube in said radial direction.

2. In a hair dryer including a housing defining air inlet and outlet means, an electric motor mounted in said housing, a fan driven by said motor for creating an air flow through said housing from said inlet to said outlet, a heater assembly mounted in said housing, a reflector secured in said housing, and circuit means for operating said motor and heater assembly, the improvement wherein said heater assembly comprises: a quartz glass heating tube for providing a radiant heat source, said tube having a generally annular shape about a central axis therethrough thereby defining axial and radial directions, the tube having opposite ends adjacent but circumferentially spaced apart, said tube being situated in said housing axially intermediate said inlet and outlet means at least partially in the path of said air flow, and support means for securing said tube to said housing intermediate said reflector and outlet means comprising a primary support engaging said ends of said quartz tube and at least two secondary supports, the location of the primary support with respect to the clock face reference being at 6 o'clock and the locations of said secondary supports being at approximately 10 and 2 o'clock respectively, each of said supports having a first part at least partially encircling and resiliently holding the tube and a second part mounted in said housing, each of said supports permitting at least a small amount of motion of said tube in said axial direction relative to said housing, said supports also providing resilient cushioning support for said tube in said radial direction.

3. In a hair dryer including a housing defining a front outlet, a heater assembly mounted in said housing, a reflector secured in said housing, and circuit means for operating said heater assembly, the improvement wherein said heater assembly comprises: a quartz glass heating tube for providing a radiant heat source, said tube having a generally annular shape thereby defining axial and radial directions, the tube having opposite ends adjacent and situated at a first location on the circumference thereof, the tube being situated axially intermediate said reflector and said front outlet, and a plurality of supports spaced circumferentially along said tube for securing said tube in said housing, each support comprising a first part at least partially encircling and resiliently holding said tube and a second part secured in said housing, each of said supports permitting at least a small amount of motion of said tube in said axial direction relative to said housing, said supports also providing resilient cushioning for said tube in said radial direction.

4. Apparatus according to claim 1 wherein each of said secondary supports comprises as said first part of spring metal strap having a first portion secured to said reflector and extending around the tube and terminating in an remote portion, and as said second part of a spring wire engaging said first and remote portions and resiliently urging said strap tightly about said tube.

5. Apparatus according to claim 1 further comprising heat resistant material intermediate said tube and each of said primary and secondary supports.

6. Apparatus according to claim 1 further comprising glass wool batting packed between said ends of said tube and said first part.

7. Apparatus according to claim 6 wherein said first part of said primary support is generally U-shaped collar having a closed end closely about said tube ends and having legs engaging said reflector, said collar being slightly pivotable relating to said reflector in said axial direction.

8. Apparatus according to claim 5 wherein said heat resistant material comprises fiber glass fabric or fiber glass wool batting.

9. Apparatus according to claim 8 wherein said heat resistant material is a fiber glass fabric sheath generally encasing each of said secondary supports.

* * * * *

UNITED STATES PATENT AND TRADEMARK OFFICE

CERTIFICATE OF CORRECTION

PATENT NO. : 4,395,619

DATED : July 26, 1983

INVENTOR(S) : Hiroshi Harigai

It is certified that error appears in the above-identified patent and that said Letters Patent is hereby corrected as shown below:

Col. 1, line 15, change "achiev-" to --achieve--;
line 16, delete "ing";
line 44, insert comma after "shatter".
Col. 2, line 50, insert --being-- after "then".
Col. 3, line 9, delete comma after "reflector";
line 34, insert --a-- after "is".
Col. 4, line 1, delete comma after "motor";
line 15, change "E" to --C--;
line 37, insert --being-- before "most";
line 45, change "securing" to --securely--;
line 58, change "tions" to --tion--.
Col. 5, line 6, change "of" (first occurrence) to --or--;
line 23, insert comma after "54";
line 51, insert comma after "axis";
line 60, change "positions;" to --position;--.
Col. 6, line 14, change "appears" to --appear--;
line 16, change "nichrome" to --Nichrome--;
line 19, change "42" to --62--.
Col. 7, line 4, insert comma after "reference".
Col. 8, line 20, change "of" to --a--;
line 23, change "an" to --a-- and delete "of";
line 31, change "first part" to --primary support--.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*